US009346025B2

(12) United States Patent
Liu et al.

(10) Patent No.: US 9,346,025 B2
(45) Date of Patent: May 24, 2016

(54) STERILE FILLING SYSTEM FOR ON-LINE PARTICLE ADDING

(75) Inventors: Aiyuan Liu, Shanghai (CN); Jian Zhang, Shanxi (CN); Peng Sun, Shanghai (CN); Jun Liu, Shanghai (CN)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 368 days.

(21) Appl. No.: 13/580,854

(22) PCT Filed: Feb. 23, 2011

(86) PCT No.: PCT/CN2011/071206

§ 371 (c)(1),
(2), (4) Date: Aug. 23, 2012

(87) PCT Pub. No.: WO2011/103802

PCT Pub. Date: Sep. 1, 2011

(65) Prior Publication Data

US 2012/0312405 A1 Dec. 13, 2012

(30) Foreign Application Priority Data

Feb. 23, 2010 (CN) ..... 2010 2 0136555 U

(51) Int. Cl.
*B01F 5/04* (2006.01)
*B01F 3/08* (2006.01)
(Continued)

(52) U.S. Cl.
CPC ..... *B01F 3/0865* (2013.01); *B01F 3/0873* (2013.01); *B01F 5/20* (2013.01);
(Continued)

(58) Field of Classification Search
CPC ..... B01F 15/00071; B01F 3/0865; B01F 3/0873; B01F 5/20; B01F 3/0861; B01F 2215/0014; B01F 15/0429
USPC ..... 137/240, 896, 897; 366/160.1, 160.2
See application file for complete search history.

(56) References Cited

U.S. PATENT DOCUMENTS 3,502,103 A * 3/1970 Verschuur ..... 137/565.33
4,468,127 A * 8/1984 Agosta ..... 366/160.1
(Continued)

FOREIGN PATENT DOCUMENTS

CN 101427724 A 5/2009
CN 101543246 A 9/2009
(Continued)

OTHER PUBLICATIONS

International Search Report (PCT/ISA/210) issued on Jun. 2, 2011, by the Chinese Patent Office as the International Searching Authority for International Application No. PCT/CN2011/071206.

*Primary Examiner* — Craig Schneider
*Assistant Examiner* — Angelisa L Hicks
(74) *Attorney, Agent, or Firm* — Buchanan Ingersoll & Rooney PC

(57) ABSTRACT

The present invention relates to a sterile filling system, and specifically relates to a sterile filling system for on-line particle adding comprising a filling system, characterized in that it further comprises a system for on-line particle adding. The filling system comprises a first AP valve bank and an injection pipe, the first AP valve bank and the injection pipe being in connection with each other; and the system for on-line particle adding comprises a second AP valve bank, the second AP valve bank being in connection with the injection pipe. The present invention can achieve the object of addition of solid particles during the production of liquid product, and ensure that the finished product will meet the requirement for sterility.

31 Claims, 7 Drawing Sheets

(51) Int. Cl.

| | |
|---|---|
| ***B01F 5/20*** | (2006.01) |
| ***B01F 15/00*** | (2006.01) |
| ***B65B 55/18*** | (2006.01) |
| ***B65B 9/12*** | (2006.01) |

(52) U.S. Cl.

CPC ..... *B01F15/00071* (2013.01); *B65B 9/12* (2013.01); *B65B 55/18* (2013.01); *B01F 2215/0014* (2013.01); *B01F 2215/0431* (2013.01); *B65B 2220/14* (2013.01); *Y10T 137/87652* (2015.04)

(56) References Cited

U.S. PATENT DOCUMENTS

| | | | | |
|---|---|---|---|---|
| 4,606,174 | A | 8/1986 | Berg | |
| 4,979,091 | A * | 12/1990 | Albers | 700/67 |
| 5,179,970 | A * | 1/1993 | Jarocki et al. | 137/9 |
| 7,401,613 | B2 * | 7/2008 | Carhuff et al. | 134/22.18 |
| 8,046,976 | B2 | 11/2011 | Schubert et al. | |
| 2004/0118291 | A1 | 6/2004 | Carhuff et al. | |
| 2006/0285429 | A1 * | 12/2006 | Kamimura et al. | 366/160.2 |
| 2008/0092888 | A1 * | 4/2008 | Haroutunian | 128/203.29 |
| 2008/0145510 | A1 | 6/2008 | Hattori | |
| 2008/0163896 | A1 * | 7/2008 | Ioannone | 134/18 |
| 2009/0014464 | A1 * | 1/2009 | Adbelmoteleb et al. | 222/1 |
| 2009/0236007 | A1 | 9/2009 | Clusserath et al. | |
| 2010/0031825 | A1 * | 2/2010 | Kemp | 99/275 |

FOREIGN PATENT DOCUMENTS

| | | | |
|---|---|---|---|
| CN | 201647160 | U | 11/2010 |
| DE | 2230185 | A1 | 1/1974 |
| FR | 2708563 | A1 | 2/1995 |
| JP | 60-204411 | A | 10/1985 |
| JP | 2-166091 | A | 6/1990 |
| JP | 4-041899 | U | 4/1992 |
| JP | 6-046752 | A | 2/1994 |
| JP | 6-141824 | A | 5/1994 |
| JP | 2000-060450 | A | 2/2000 |
| JP | 2005-304390 | A | 11/2005 |
| JP | 2009-544544 | A | 12/2009 |
| JP | 2010-274971 | A | 12/2010 |
| RU | 2000132898 | A | 1/2003 |
| WO | 9826862 | A1 | 6/1998 |
| WO | 0235947 | | 5/2002 |
| WO | 2005018788 | | 3/2005 |
| WO | 2008014333 | A2 | 1/2008 |
| WO | 2008037338 | A1 | 4/2008 |
| WO | 2010017888 | | 2/2010 |

* cited by examiner

STERILE FILLING SYSTEM FOR ON-LINE PARTICLE ADDING

TECHNICAL FIELD

The present invention relates to a sterile filling system, and specifically relates to a sterile filling system for on-line particle adding.

BACKGROUND

A requirement of the current market is to add particles into liquid product A. The existing sterile filling system, such as Tetra Pak's sterile packaging technology, mainly comprises two parts, namely a filling part and a cleaning part. However, at present time, there is no a device for adding solid particles into the liquid product A during filling production thereof. The liquid product A may be various liquid foods such as milk, fruit juice, soymilk, modulated milk, drink and the like, and a liquid product B may be various nutritive, special-flavoured liquid product, and the particles are solid.

Accordingly, there is a need for a device which enables fill the particles into the liquid product A during production thereof. The finished product is required to be a sterile product.

SUMMARY OF THE INVENTION

The present invention is intended to add particle on-line into the liquid product A, and ensure that a solid-liquid mixed product C is maintained in sterile state.

A sterile filling system for on-line particle adding according to the present invention comprising a filling system, characterized in that it further comprises a system for on-line particle adding.

The filling system comprises a first AP valve bank and an injection pipe, the first AP valve bank and the injection pipe being in connection with each other; and the system for on-line particle adding comprises a second AP valve bank, the second AP valve bank being in connection with the injection pipe.

The filling system according to the present invention further comprises an on-line cleaning system.

The cleaning system comprises an outer cleaning station and a plurality of reversible pipes, the reversible pipes being detachably connected to channels of the filling system and being capable of connecting to the outer cleaning station, the filling system, and the system for on-line particle adding in a reversible manner to form series connected cleaning pipeline.

When the filling system according to the present invention being used, the solid-liquid mixed product C can be prepared by intensive mixing the liquid product A and liquid product B in the injection pipe, and finally a sterile packaging product can be formed by filling the solid-liquid mixed product C through the injection pipe into a molding unit, wherein the liquid product A is added to the injection pipe by the first AP valve bank, and the liquid product B is added to the injection pipe by the second AP valve bank. The packaging is required to be completed under sterile conditions in the whole process.

Reference symbols in the figures are as follows:

| | | | |
|---|---|---|---|
| A. | liquid product A | 259. | ninth segment |
| B. | liquid product B | 250. | through-holes |
| C. | solid-liquid mixing product C | 11B. | B valve of the first AP valve bank |
| 11. | first AP valve bank | 26. | second communicating pipe |
| 12. | first flow control valve | 31. | injection pipe |
| 21. | second AP valve bank | 311. | curved part |
| 22. | second flow control valve | 32. | sterile tank |
| 23. | flow transducer | 33. | molding unit |
| 24. | dosing valve | 41. | filling pipe |
| 25. | mixing nozzle | 42. | outer cleaning station |
| 251. | first segment | 43. | first reversible pipe |
| 252. | second segment | 44. | second reversible pipe |
| 253. | third segment | 45. | third reversible pipe |
| 254. | fourth segment | 21B. | B valve of the second AP valve bank |
| 255. | fifth segment | | |
| 256. | sixth segment | K. | pre-sterilization temperature |
| 257. | seventh segment | J. | junction |
| 258. | eighth segment | BF. | butterfly valve |

DETAILED DESCRIPTION OF THE PREFERRED EMBODIMENTS

The liquid product B is liquid, and it can be solidified immediately to form solid particles when it meets the liquid product A. According, the solid particles can be put into the liquid product an on-line by adding the liquid product B during production of the liquid product A and using the mixed characteristic of the two products so that a sterile solid-liquid mixing product C containing the solid particles is formed in a finished product.

Figure 1:
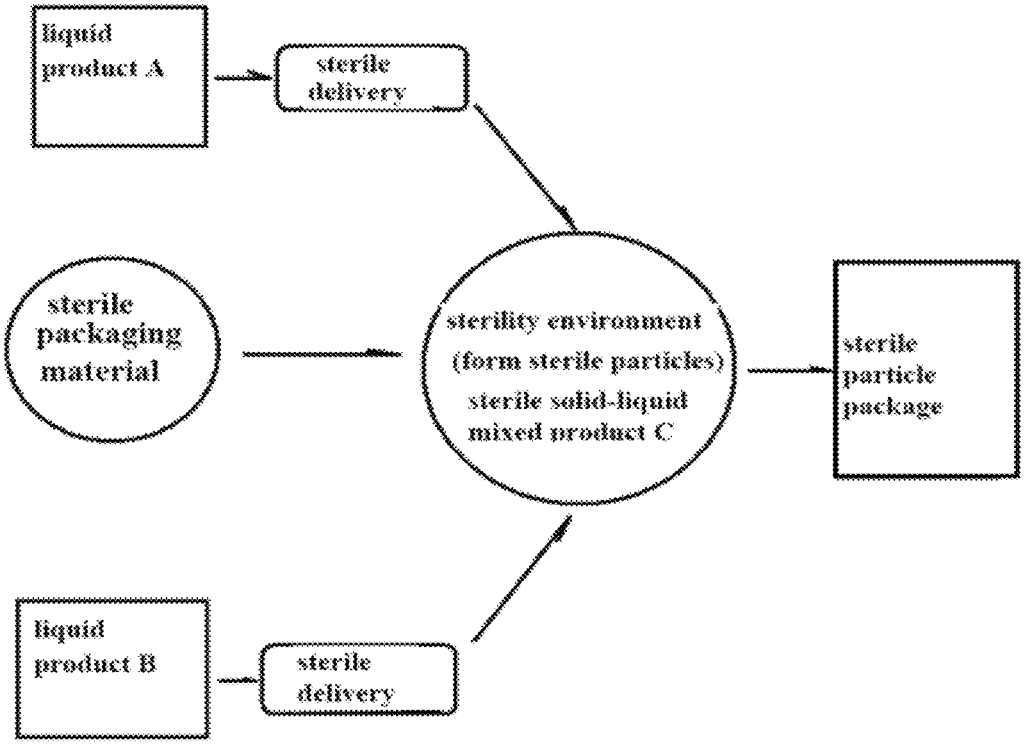
FIG. 1 is a schematic diagram of working principle of the present invention.

As shown in FIG. 1, the principle of the present invention is that the liquid product A and the liquid product B are simultaneously delivered under sterility condition and then mixed in sterility environment to form the mixing product C containing the solid particles which will be filled into a sterile packaging material to form a sterile particle package.

It should be ensured that during the delivery and filling process the liquid product A reached the first AP valve bank 11 is sterile, and the liquid product B reached the second AP valve bank 21 is sterile, and the sterile solid-liquid mixing product C containing the solid particles is formed by mixing the sterile liquid product A with the sterile liquid product B in a sterile state at the mixing nozzle 25. Each process of the production of the sterile solid-liquid mixing product C containing the solid particles is sterilized to achieve sterility. The sterilization methods mainly comprise hot air sterilization or hydrogen peroxide sterilization.

Figure 2:
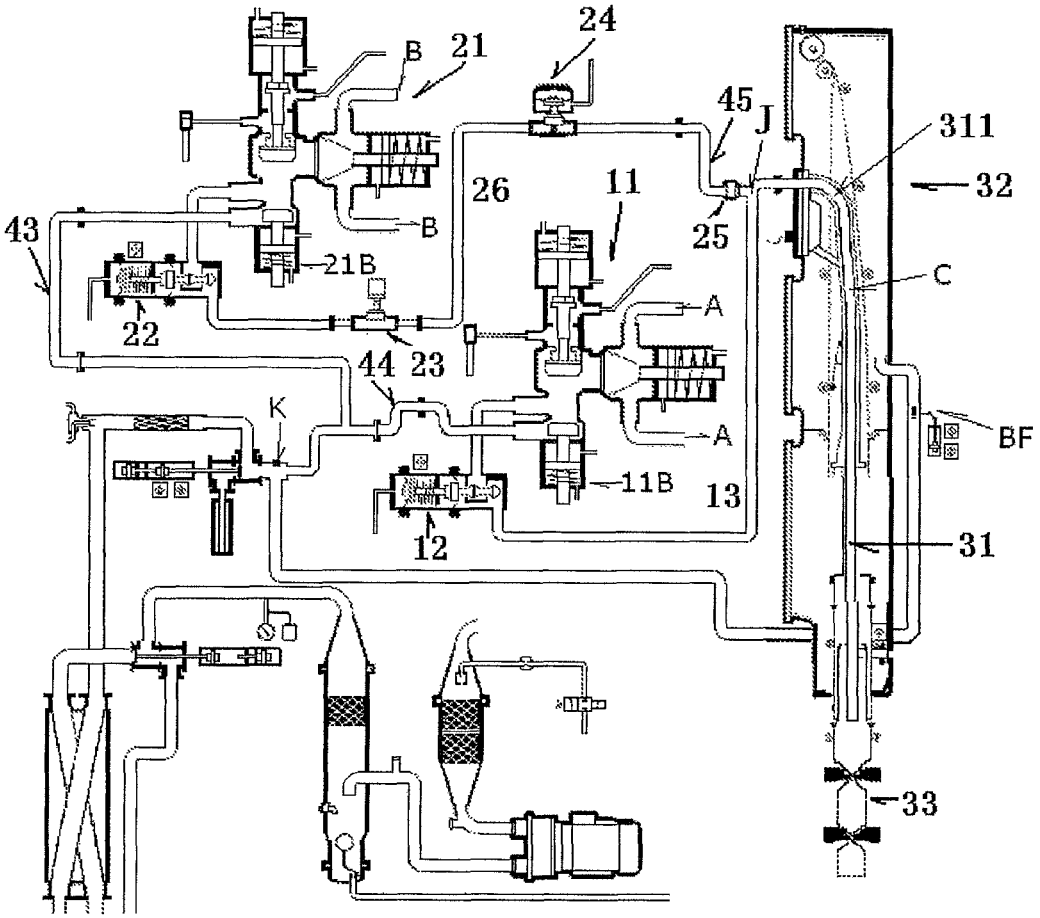
FIG. 2 is a schematic diagram of production of a product of the present invention.

As shown in FIG. 2, the present invention comprises a filling system and a system for on-line particle adding. The present invention comprises an injection pipe 31, a first AP valve bank 11 (sterile product valve bank) and a second AP valve bank 21 (sterile product valve bank). The first AP valve bank 11 is in connection with the injection pipe 31 through a first flow control valve 12. The second AP valve bank 21 is in connection with the injection pipe 31 through a second flow control valve 22. The second flow control valve 22 is in connection with the injection pipe 31 through a second communicating pipe 26.

A flow transducer 23 and a dosing valve 24 are disposed on the second communicating pipe 26, and a mixing nozzle 25 is disposed at the end of the second communicating pipe 26 and at the junction of the second communicating pipe 26 and the injection pipe 31. The mixing nozzle 25 is also in connected with the injection pipe 31.

The first AP valve bank 11 is used to add the liquid product A into the injection pipe 31 while the second AP valve bank 21 is used to add the liquid product B into the injection pipe 31, and the liquid product A meets with the liquid product B at the mixing nozzle 25 to form particles in the injection pipe 31 so that the particles can be filled into the package at the molding unit 33 of the sterile solid-liquid mixing product C.

Without using the flow transducer 23 and the dosing valve 24, the content ratio of the solid particles in the sterile solid-liquid mixing product C can be controlled precisely by controlling the first flow control valve 12 and the second flow control valve 22.

With using the flow transducer 23 and the dosing valve 24, the content ratio of the solid particles in the sterile solid-liquid mixing product C can be controlled precisely by controlling the first flow control valve 12, the second flow control valve 22, the flow transducer 23 and the dosing valve 24.

The flow transducer 23 is used to monitor the flow of the liquid product B in the second communicating pipe 26.

Figure 4:
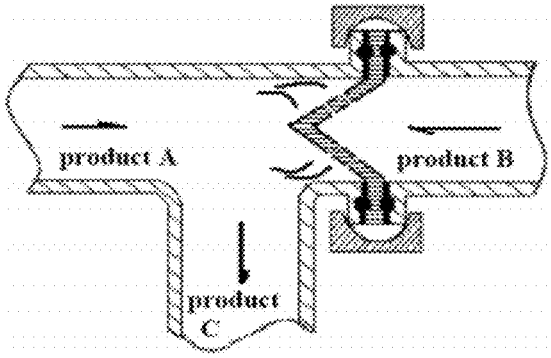
FIG. 4 is a schematic diagram of working principle of the mixing nozzle.

As shown in FIG. 4, the working principle and function of the mixing nozzle 25 are that the liquid product B can be sprayed out from the through-holes 250 of the mixing nozzle 25 when the product pressure of the liquid product B is greater than that of the liquid product A so that the liquid product B meets the liquid product A and can be solidified immediately to form solid particles. According, the solid particles can be put into the liquid product an on-line by using the mixed characteristic of the two products, thereby a sterile solid-liquid mixing product C containing the solid particles is formed in the finished product.

The present invention is desired to be sterilized to conduct the production in a sterile state. The sterilization methods mainly comprise hot air sterilization or hydrogen peroxide sterilization. The injection pipe 31 is disposed in the sterile tank 32.

Figure 3:
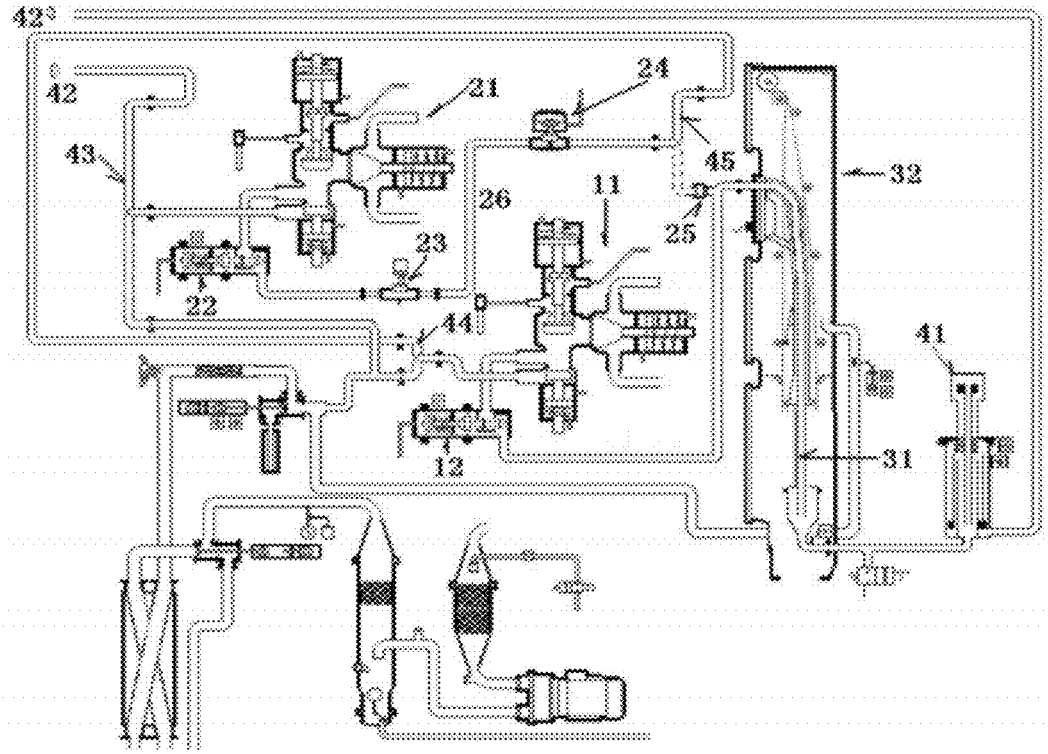
FIG. 3 is a schematic diagram of cleaning the pipe of the present invention.

As shown in FIG. 3, a method of series cleaning is used for the cleaning of the present invention, which comprises a cleaning pipeline which is in connection with the second AP valve bank 21, the first AP valve bank 11 and injection pipe 31 in turn. When the pipes are cleaning, the cleaning solution travels from the outer cleaning station 42 to the second AP valve bank 21 through reversible pipe 43, and travels to the second AP valve bank 22, the flow transducer 23 (optional component) and the dosing valve 24 (optional component) in turn, then travels to the first AP valve bank 11 through the reversible pipes 45, 44, and then travels to the first flow control valve 12 and the injection pipe 31 in turn. The injection pipe 31 is in connection with the outer cleaning station 42 through the filling pipe 41. The cleaning circulation is finished after the cleaning solution travels out from the injection pipe 31 and back to the outer cleaning station 42 through the filling pipe 41. The cleaning solution is driven by standard cleaning solution provided by the outer cleaning station 42. The mixing nozzle is taken out to be cleaned manually during the cleaning. Accordingly, the system is cleaned effectively and thoroughly after the production. The cleaning pipeline achieves the clean-in-place (CIP) function of the present system with the aid of the existing pipes for production according to the present invention.

The filling pipe 41 herein has a function that it can be cleaned thoroughly by being inserted into the cleaning circuit during the cleaning, and then taken out after the cleaning is finished to connect to the injection pipe 31 to form a filling pipeline finally so that the filling liquid level of the solid-liquid mixed product C being controlled precisely can be monitored.

When the cleaning is required for the present invention after the production, a new cleaning pipeline can be formed by changing the connection of the pipes used for the production of the present invention by reversing the first reversible pipe 43, the second reversible pipe 44 and the third reversible pipe 45 as depicted in FIG. 3 only from bottom (dotted lines) to top (solid line) to connect with the corresponding cleaning pipeline. Specifically, as shown in FIG. 3, the first reversible pipe 43, the second reversible pipe 44 and the third reversible pipe 45 are detachably connected to the production pipeline. When the cleaning is required for the present invention after the production, one end of the first reversible pipe 43, the second reversible pipe 44 and the third reversible pipe 45 is detached and turned over respectively to connect to the corresponding pipe coupling of the cleaning pipeline so that a closed cleaning pipeline is formed. Accordingly, the cleaning according to the present invention can be achieved with the aid of the existing pipes for production according to the present invention without reconnection of independent cleaning pipeline, thereby improving productive efficiency and reducing equipment costs.

All of the steps of the above-mentioned sterile on-line continuous forming and filling of particles are controlled by process control soft wares.

As shown in FIG. 2, the second AP valve bank 21 is in connection with the injection pipe 31 through the mixing nozzle 25, and is also in connection with the first AP valve bank 11 through the mixing nozzle 25. The second AP valve bank 21 is in connection with the second communicating pipe 26, and the first AP valve bank 11 is in connection with a first communicating pipe 13, the second communicating pipe 26 meeting the first communicating pipe 13 at a junction J, and the injection pipe 31 bending at a curved part, thereby the injection pipe 31 comprising horizontal and vertical injection pipes 31. The mixing nozzle 25 is disposed on the second communicating pipe 26 and near the junction J.

The horizontal injection pipe is required to have a certain length because that if the liquid product B is mixed with the liquid product A in the vertical injection pipe, the solid particles are difficult to formed due to the influence of gravity and the like. However it is disadvantageous for the sterilization of the product if the length of the horizontal injection pipe is too long. Accordingly, the distance of the end of the mixing nozzle 25 near the junction from the curved part is between 1 m and 3 m.

Preferably, the distance of the end of the mixing nozzle 25 near the junction from the curved part is between 2 m and 2.5 m.

Preferably, the distance of the end of the mixing nozzle 25 near the junction from the curved part is between 1.5 m and 2 m.

Figure 5:
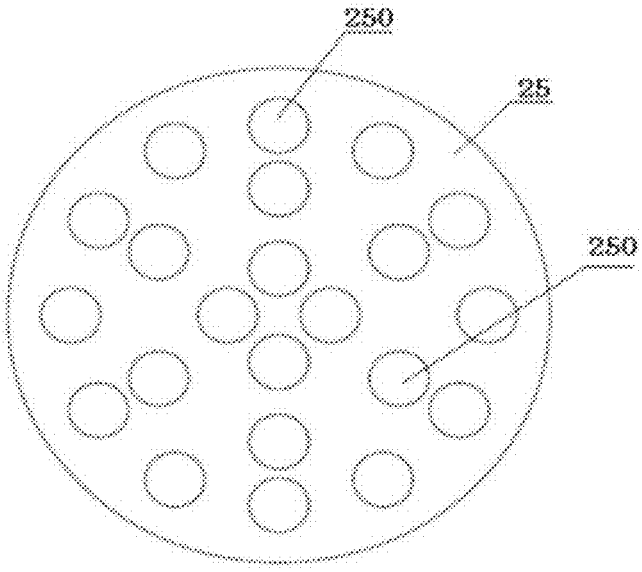
FIGS. 5 and 6 are top view and side view of the mixing nozzle in example 1.

According to example 1 illustrated by FIG. 5, the mixing nozzle 25 possesses a plurality of through-holes 250 which are in connection with the second AP valve bank 21 and the injection pipe 31 and further in connection with the second AP valve bank 21 and the first AP valve bank 11. The amount of the through-holes 250 in the mixing nozzle 25 ranges from 16 to 24. The through-holes 250 are arranged in an optional equispaced-arrangement manner.

Figure 6:
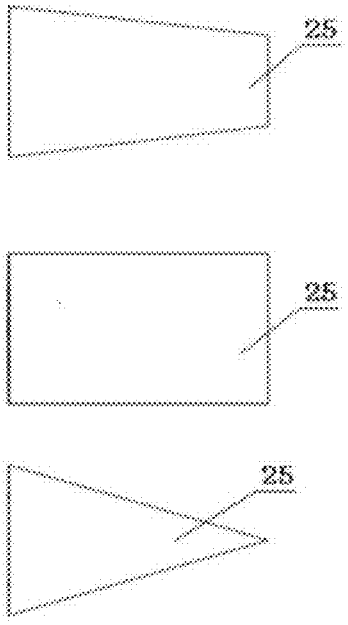

As shown in FIG. 6, the shape of mixing nozzle 25 is cylinder-, cone- or circular truncated cone-shaped. The mixing nozzle 25 has a length along the direction of the through-holes ranging from 10 mm to 60 mm. The length of the mixing nozzle 25 is dependent on the shape thereof and the distance of the end thereof near the junction J from the curved part.

Figure 7:
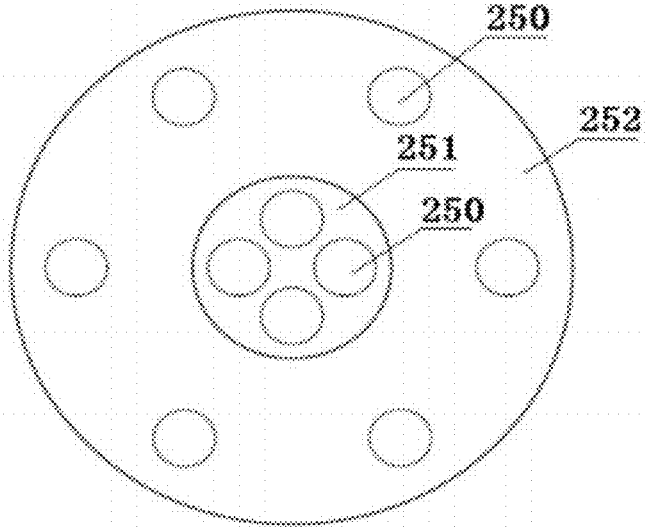
FIGS. 7 and 8 are top view and side view of the mixing nozzle in example 2.
Figure 8:
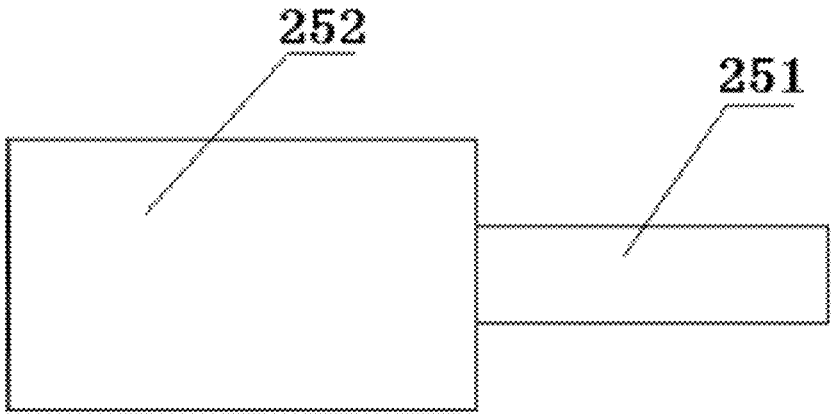

According to example 2 illustrated by FIGS. 7 and 8, the mixing nozzle 25 is configured into two segments which consist of a first segment 251 and a second segment 252, each of which having different radial size, and the first segment 251 being in connection with the second segment 252, thereby the whole mixing nozzle 25 having a ladder shape. The first segment 251 and the second segment 252 are configured to have the through-holes 250 with an amount ranging from 8 to 16. The through-holes 250 are arranged in an optional equispaced-arrangement manner. The length along the direction of the through-holes of the first segment 251 and the second segment 252 are respectively one selected from the group consisting of 15 mm/20 mm, 20 mm/20 mm and 30 mm/30 mm.

Figure 9:
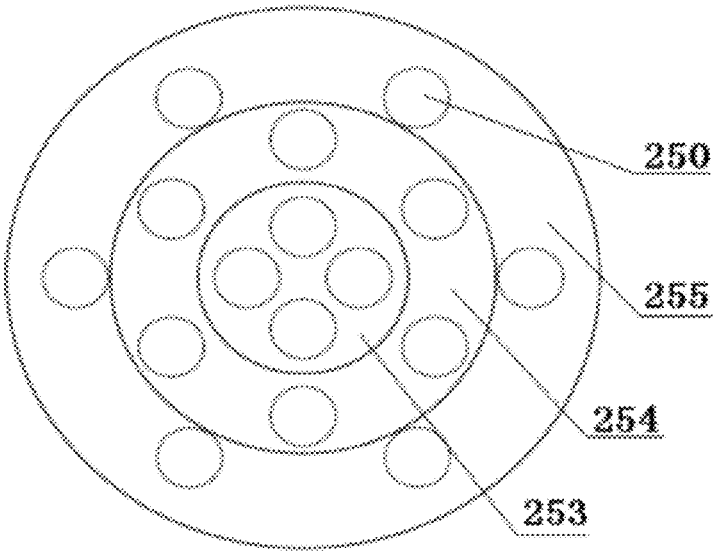
FIGS. 9 and 10 are top view and side view of the mixing nozzle in example 3.
Figure 10:
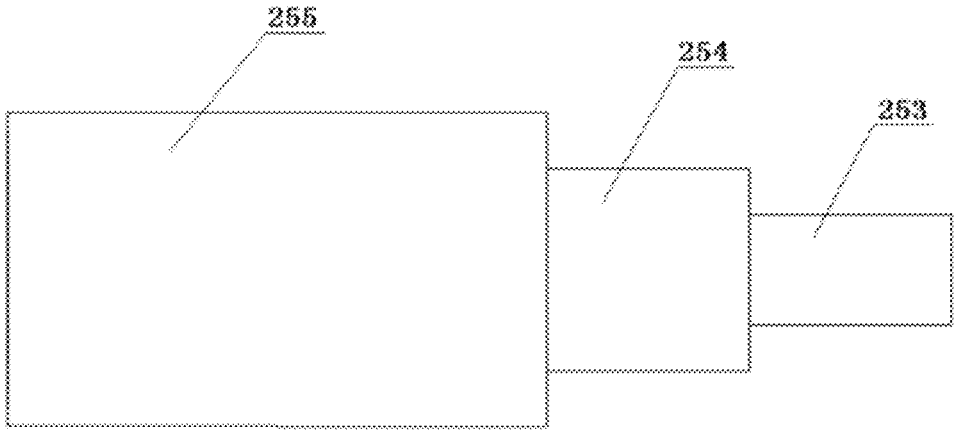
Figure 11:
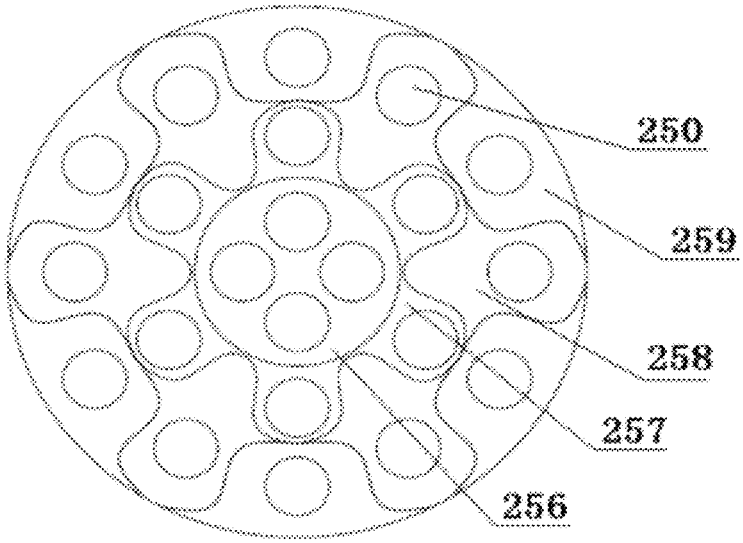
FIGS. 11 and 12 are top view and side view of the mixing nozzle in example 4.

According to example 3 illustrated by FIGS. 9 and 10, the mixing nozzle 25 is configured into three segments which consist of a third segment 253, a fourth segment 254 and a fifth segment 255, each of which having different radial size, and the segments from 253 to 255 being connected in turn, thereby the whole mixing nozzle 25 having a ladder shape. The third segment 253, the fourth segment 254 and the fifth segment 255 are configured to have the through-holes 250 with an amount ranging from 16 to 22. The length along the direction of the through-holes of the third segment 253, the fourth segment 254 and the fifth segment 255 are respectively one selected from the group consisting of 15 mm/15 mm/20 mm, 15 mm/20 mm/20 mm and 20 mm/20 mm/20 mm. The shape of each segment of the mixing nozzle 25 is cylinder- or corrugated pipe-shaped. For example, the third segment 253 and the fourth segment 254 are configured to be corrugated pipe-shaped. The so-called corrugated pipe-shaped is similar to the shape of gears as shown in FIG. 11. The through-hole 250 is disposed on each thick gear.

Figure 12:
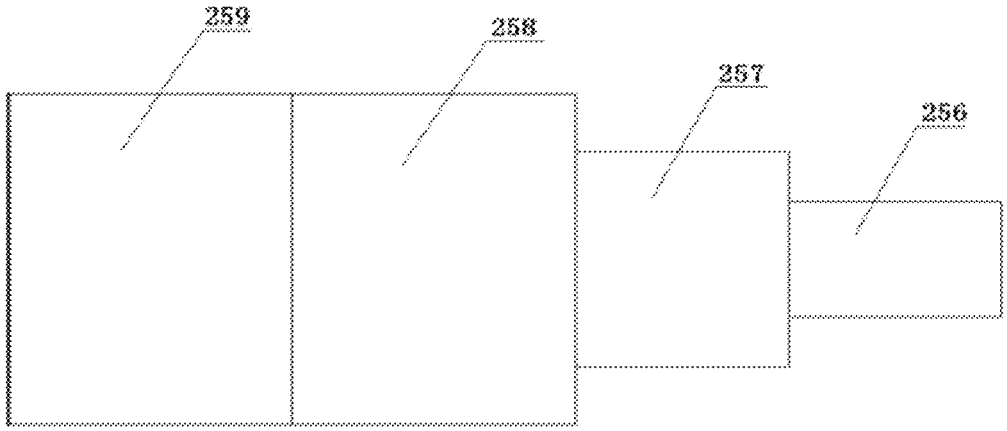

According to example 4 illustrated by FIGS. 11 and 12, the mixing nozzle 25 is configured into four segments which consist of a sixth segment 256, a seventh segment 257, a eighth segment 258 and a ninth segment 259, each of which having different radial size, and the segments from 256 to 259 being connected in turn, thereby the whole mixing nozzle 25 having a ladder shape. The segments from 256 to 259 are configured to have the through-holes 250 with an amount ranging from 16 to 22. The mixing nozzle 25 has a total length ranging from 45 mm to 80 mm. The lengths along the direction of the through-holes of the segments from 256 to 259 respectively are 15 mm/15 mm/20 mm/20 mm. The shape of each segment of the mixing nozzle 25 is cylinder- or corrugated pipe-shaped.

The diameters of the through-holes according to the above-mentioned multiple examples are between 1.2 mm to 3.0 mm. The amount of the through-holes in the above-mentioned mixing nozzle 25 is dependent on the requirement for sterilization of user and for the addition proportion of the solid particle. The mixing nozzle 25 can also be configured into more than four segments, and each segment of the mixing nozzle 25 (from the first segment 251 to the ninth segment 252) ranges respectively from 10 mm to 50 mm. The term "multiple" according to the present invention refers to two or more.

In order to ensure that the production is carried out in the sterile state, the sterile filling system is required to be sterilized before carrying out the production. The sterilization steps mainly comprise the steps of drying, pre-sterilization, spraying and drying and so on.

Firstly, the drying step is carried out. The pipeline of the system is blown for about 6 minutes to remove the residual moisture within the pipeline, thereby drying the pipeline.

Secondly, the pre-sterilization step is carried out. The pipeline of the system is sterilized at high temperature.

When the pre-sterilization temperature K is less than a predetermined value, the B valve of the second AP valve bank 21B is closed, and the sterile air flows through the B valve of the first AP valve bank 11B, the first flow control valve 12 and the injection 31 to the sterile tank 32.

When the pre-sterilization temperature K is greater than a predetermined value in a certain range, the B valve of the first AP valve bank 11B is closed, and the sterile air flows through the first reversible pipe 43, the B valve of the second AP valve bank 21B, the second flow control valve 22, the flow transducer 23, the dosing valve 24, the third reversible pipe 45, the mixing nozzle 25 and the injection 31 to the sterile tank 32.

When the pre-sterilization temperature K reaches the predetermined spray temperature, a few minutes later the B valve of the second AP valve bank 21B and the B valve of the first AP valve bank 11B open simultaneously.

Thirdly, the spraying step is carried out. The system is required to be sprayed twice, and the pipeline of the system is required to be sprayed with hydrogen peroxide ($H_2O_2$) for sterilization.

The first spray is carried out. After the start of the first spray, the B valve of the second AP valve bank 21B close. At the same time the B valve of the first AP valve bank 11B open. The pipeline for the liquid product A is sterilized by flowing the atomizing $H_2O_2$ through the B valve of the first AP valve bank 11B, the first flow control valve 12 and the injection pipe 31 to the sterile tank 32.

The B valve of the second AP valve bank 21B and the B valve of the first AP valve bank 11B close simultaneously within a certain time before the end of the first spray.

The second spray is carried out. After the pre-sterilization temperature K reaches the predetermined spray temperature, a certain time later the second spray is performed.

The B valve of the second AP valve bank 21B open and the B valve of the first AP valve bank 11B close simultaneously at the beginning of the second spray. The pipeline for the liquid product B is sterilized by flowing the atomizing $H_2O_2$ through the first reversible pipe 43, the B valve of the second AP valve bank 21B, the second flow control valve 22, the flow transducer 23, the dosing valve 24, the third reversible pipe 45, the mixing nozzle 25 and the injection pipe 31 to the sterile tank 32.

The B valve of the second AP valve bank 21B and the B valve of the first AP valve bank 11B close simultaneously within a certain time before the end of the second spray.

It is desired that the B valve of the second AP valve bank 21B open for 5 seconds at the beginning of the first spray and then close again, which can make sure that the residual air within the first reversible pipe 43, the B valve of the second AP valve bank 21B, the second flow control valve 22, the flow transducer 23, the dosing valve 24, the third reversible pipe 45, the mixing nozzle and the additional pipe has been sterilized before the second spray.

Fourthly, the drying step is carried out. The hydrogen peroxide ($H_2O_2$) within the system is required to be dried after carrying out the two sprays.

The B valve of the second AP valve bank 21B and the B valve of the first AP valve bank 11B will open and close interchangeably to dry the two pipes.

The butterfly valve BF will open and close based on the open states of the B valve of the second AP valve bank 21B and the B valve of the first AP valve bank 11B.

The sterility environment around the system is ensured after performing the steps of drying, pre-sterilization, spraying and drying and so on, thereby preparing for the subsequent production.

When carrying out the production, the second AP valve bank 21 open at first, and a certain times later the first AP valve bank 11 open, and the solid-liquid mixed product C flows through the injection pipe 31 to the molding unit 33 to form the final sterile packaging product.

The present invention illustrated only with reference to the embodiments is not intended to limit the scope of the present invention. It is easy for those skilled in the art to carry out various different alternation, modification and utilization of equivalent manner without depart from the scope of the claims, which all fall into the scope of the present invention.

The invention claimed is:

1. A sterile filling system for on-line particle adding comprising:

a filling system;

a system for on-line particle adding;

the filling system comprising a first AP valve bank and an injection pipe connected to each other;

the system for on-line particle adding comprising a second AP valve bank;

the second AP valve bank being connected to the injection pipe through a communicating pipe and a mixing nozzle;

the second AP valve bank being connected to the first AP valve bank through the mixing nozzle so that a first product being conveyed along the injection pipe from the first AP valve bank is mixed with a second product which has been ejected from the mixing nozzle downstream of the mixing nozzle, the second product being from the second AP valve bank;

the mixing nozzle being disposed on the communicating pipe; and wherein the first AP valve bank and the second AP valve bank are connected to the injection pipe through the mixing nozzle.

2. The sterile filling system for on-line particle adding according to claim 1, wherein the second AP valve bank is connected to the injection pipe through a second flow control valve.

3. The sterile filling system for on-line particle adding according to claim 2, wherein the second flow control valve is connected to the injection pipe through the communicating pipe, on which pipe is disposed a flow transducer and a dosing valve.

4. The sterile filling system for on-line particle adding according to claim 1, wherein the first AP valve bank is connected to the injection pipe through a first flow control valve.

5. The sterile filling system for on-line particle adding according to claim 1, further comprising an on-line cleaning system.

6. The sterile filling system for on-line particle adding according to claim 5, wherein the cleaning system comprises an outer cleaning station and a plurality of reversible pipes, the reversible pipes being detachably connected to channels of the filling system and being configured to connect to the outer cleaning station, the filling system, and the system for on-line particle adding in a reversible manner to form series connected cleaning pipeline.

7. The sterile filling system for on-line particle adding according to claim 6, wherein the injection pipe is connected to the outer cleaning station through a filling pipe.

8. The sterile filling system for on-line particle adding according to claim 1, wherein the communicating pipe is a second communicating pipe, the second AP valve bank is connected to the second communicating pipe, and the first AP valve bank is connected to a first communicating pipe, the second communicating pipe meeting the first communicating pipe at a junction, and the injection pipe bending at a curved part.

9. The sterile filling system for on-line particle adding according to claim 8, wherein the mixing nozzle is disposed near the junction and a distance of the end of the mixing nozzle near the junction from the curved part is between 1 m and 3 m.

10. The sterile filling system for on-line particle adding according to claim 9, wherein the distance of the end of the mixing nozzle near the junction from the curved part is between 2 m and 2.5 m.

11. The sterile filling system for on-line particle adding according to claim 9, wherein the distance of the end of the mixing nozzle near the junction from the curved part is between 1.5 m and 2 m.

12. The sterile filling system for on-line particle adding according to claim 9, wherein the mixing nozzle possesses a plurality of through-holes which are connected to the second AP valve bank and the injection pipe and further connected to the second AP valve bank and the first AP valve bank.

13. The sterile filling system for on-line particle adding according to claim 12, wherein the shape of mixing nozzle is cylinder-, cone- or circular truncated cone-shaped.

14. The sterile filling system for on-line particle adding according to claim 13, wherein the mixing nozzle has a length along the direction of the through-holes ranging from 10 mm to 60 mm.

15. The sterile filling system for on-line particle adding according to claim 14, wherein the amount of the through-holes in the mixing nozzle ranges from 16 to 24.

16. The sterile filling system for on-line particle adding according to claim 14, wherein the mixing nozzle is configured into two segments which consist of a first segment and a second segment, each of which having different radial size, and the first segment being connected to the second segment, thereby the whole mixing nozzle having a ladder shape.

17. The sterile filling system for on-line particle adding according to claim 16, wherein the first segment and the second segment are configured to have the through-holes with an amount ranging from 8 to 16.

18. The sterile filling system for on-line particle adding according to claim 17, wherein the first segment and the second segment have a length along the direction of the through-holes respectively ranging from 10 mm to 50 mm.

19. The sterile filling system for on-line particle adding according to claim 18, wherein the length along the direction of the through-holes of the first segment and the second segment are respectively one selected from the group consisting of 15 mm/20 mm, 20 mm/20 mm and 30 mm/30 mm.

20. The sterile filling system for on-line particle adding according to claim 16, wherein the shape of each segment of the mixing nozzle is cylinder- or corrugated pipe-shaped.

21. The sterile filling system for on-line particle adding according to claim 12, wherein the mixing nozzle is configured into three segments which consist of a third segment, a fourth segment and a fifth segment, each of which having different radial size, and the segments from to being connected in turn, thereby the whole mixing nozzle having a ladder shape.

22. The sterile filling system for on-line particle adding according to claim 21, wherein the third segment, the fourth segment and the fifth segment are configured to have the through-holes with an amount ranging from 16 to 22.

23. The sterile filling system for on-line particle adding according to claim 22, wherein the third segment, the fourth segment and the fifth segment have a length along the direction of the through-holes respectively ranging from 10 mm to 50 mm.

24. The sterile filling system for on-line particle adding according to claim 23, wherein the length along the direction of the through-holes of the third segment, the fourth segment and the fifth segment are respectively one selected from the group consisting of 15 mm/15 mm/20 mm, 15 mm/20 mm/20 mm and 20 mm/20 mm/20 mm.

25. The sterile filling system for on-line particle adding according to claim 12, wherein the mixing nozzle is configured into four segments which consist of a sixth segment, a seventh segment, an eighth segment and a ninth segment, each of which having different radial size, and the sixth, seventh, eighth and ninth segments being connected in turn, thereby the whole mixing nozzle having a ladder shape.

26. The sterile filling system for on-line particle adding according to claim 25, wherein the sixth, seventh, eighth and ninth segments are configured to have the through-holes with an amount ranging from 16 to 22.

27. The sterile filling system for on-line particle adding according to claim 26, wherein the mixing nozzle has a total length ranging from 45 mm to 80 mm.

28. The sterile filling system for on-line particle adding according to claim 27, wherein the sixth, seventh, eighth and ninth segments have a length along the direction of the through-holes respectively ranging from 10 mm to 50 mm.

29. The sterile filling system for on-line particle adding according to claim 28, wherein the length along the direction of the through-holes of the segments from respectively are 15 mm/15 mm/20 mm/20 mm.

30. The sterile filling system for on-line particle adding according to claim 12, wherein the through-holes have a diameter between 1.2 mm and 3.0 mm.

31. A sterile filling system for on-line particle adding comprising:

a filling system;

a system for on-line particle adding;

the filling system comprising a first AP valve bank and an injection pipe connected to each other such that a first product to be mixed with a second product flows from the first AP valve bank toward the injection pipe;

the system for on-line particle adding comprising a second AP valve bank;

the second AP valve bank being connected to the injection pipe through a mixing nozzle so that the second product flows from the second AP valve bank toward the injection pipe;

the second AP valve bank being connected to the first AP valve bank through the mixing nozzle so that the second product flowing from the second AP valve bank enters the mixing nozzle, is sprayed out from the mixing nozzle, and then first meets the first product; and the first AP valve bank and the second AP valve bank being connected to the injection pipe through the mixing nozzle.

* * * * *